US005137219A

United States Patent [19]

Morey

[11] Patent Number: 5,137,219

[45] Date of Patent: Aug. 11, 1992

[54] WOOD CHIPPER AND INFEED SYSTEM

[75] Inventor: Norval K. Morey, Weidman, Mich.

[73] Assignee: Wood Technology, Inc., Winn, Mich.

[21] Appl. No.: 225,484

[22] Filed: Jul. 28, 1988

Related U.S. Application Data

[63] Continuation-in-part of Ser. No. 155,124, Feb. 11, 1988.

[51] Int. Cl.[5] ..... B02C 18/06; B02C 18/22

[52] U.S. Cl. ..... 241/92; 144/176; 241/101.7; 241/245; 241/280

[58] Field of Search ..... 144/176, 162 R, 246 R, 144/246 F; 241/55, 56, 92, 101.2, 101.7, 245, 232, 278 R, 280, 287, 289

[56] References Cited

U.S. PATENT DOCUMENTS

| | | | |
|---|---|---|---|
| 315,201 | 4/1885 | Willford | 241/232 X |
| 1,568,520 | 1/1926 | Martens . | |
| 1,651,372 | 12/1927 | Carline | 241/100 |
| 2,150,984 | 3/1939 | Near et al. | 241/280 |
| 2,343,757 | 3/1944 | Egedal . | |
| 3,030,987 | 4/1962 | Jackson et al. | 144/42 |
| 3,120,861 | 2/1964 | Finlay et al. | 144/246 R X |
| 3,856,212 | 12/1974 | Swatko | 241/56 |
| 3,861,602 | 1/1975 | Smith | 241/56 X |
| 3,861,603 | 1/1975 | Lautzenheiser et al. | 241/100 |
| 3,937,261 | 2/1976 | Blum | 144/218 |
| 4,078,590 | 3/1978 | Smith | 144/176 |
| 4,160,471 | 7/1979 | LaPointe | 144/176 |
| 4,390,132 | 6/1983 | Hutson et al. | 241/55 |
| 4,483,378 | 11/1984 | Chang et al. | 144/246 R X |
| 4,651,936 | 3/1987 | Fleming | 144/176 X |

FOREIGN PATENT DOCUMENTS

| | | | |
|---|---|---|---|
| 967402 | 10/1982 | U.S.S.R. | 144/246 R |

OTHER PUBLICATIONS

"Shred-It" by MTD.
Chippit II.

*Primary Examiner*—Joseph M. Gorski
*Attorney, Agent, or Firm*—Price, Heneveld, Cooper, DeWitt & Litton

[57] ABSTRACT

A brush/wood chipper having a small diameter pressing feed cylinder adjacent and parallel to an anvil which is generally perpendicular to the feed disc, the cylinder also being adjacent the chipping disc. This feed cylinder is in an infeed chute, and presses the branches, twigs or other wood against the anvil while the wood is fed to and chipped by knives on the disc. The radially oriented knives are each canted relative to the chordal anvil so that, preferably assisted by a canted feed cylinder, the wood is forced toward the center of the chipping disc. The infeed chute has a wall generally at the center of the disc. The chips are propelled to a flow arrester for discharge into bags or bypassed to a discharge chute extension, using a control valve at the flow arrester.

19 Claims, 5 Drawing Sheets

WOOD CHIPPER AND INFEED SYSTEM

RELATED APPLICATION

This application is a continuation-in-part of the copending application entitled CHIPPER BAGGER, U.S. Ser. No. 155,124 filed Feb. 11, 1988.

BACKGROUND OF THE INVENTION

This invention relates to a wood chipping machine optionally capable of also simultaneously bagging chips, and particularly to a lightweight machine effective to chip not only brush and tree prunings but also larger diameter wood, using a small engine, and if desired to directly containerize the chips by power of the chipper.

A variety of wood chipping machines have been developed over the years for accommodating materials ranging in size from whole trees as in U.S. Pat. Nos. Re. 31,048 and 4,078,590 to brush as in U.S. Pat. No. 3,861,602. The latter type machine has proven highly effective and dependable for chipping brush and small trees, and consequently is widely employed by municipal crews, commercial tree services, landscapers and the like for converting large and small branches and even smaller trees into chips. The chips are typically blown from the chipper through a discharge chute at high velocity into an awaiting trailer, or truck, or often onto the ground. Although this machine can also be used for chipping the large volume of annual tree prunings produced when fruit and nut trees are pruned, or by smaller landscapers, the basic construction of this prior machine renders it more heavy duty than needed for such use, generally too costly to be economically feasible for many such operators, and sometimes too large, bulky and/or physically heavy to be moved along the work area, e.g. along rows of trees. A chipper for orchards and grooves must be capable of quick and easy movement from tree to tree to tree hundreds of times, to be able to quickly chip the 50-75 pounds or so of branches per tree. Up to the present time, it is understood that in states such as California hundreds of thousands of dollars have been spent seeking a solution to disposal of these annual prunings, but none has resulted. Thus, these are manually thrown into piles which are put into windrows and then pushed or hauled out of the grove or orchard for mass burning. Burning and landfill disposal of the prunings is being constantly further restricted because of pollution and the like.

Another disposal problem exists with respect to old lumber resulting from replacement every 15-25 years of exterior home structures such as decks and porches, and of downed or trimmed tree limbs and the like. Landfills do not allow or want them. Burning them is often outlawed. Trash trucks will usually not take them. Disposal is a real problem. Yet, the large engine of about 75-100 h.p. and accompanying heavy duty structure previously required to chip limbs and poles up to several inches in diameter place the price out of range for most potential users. The rule of thumb in the industry is that chipping of an eight inch diameter pole does require close to 100 h.p.

The chips resulting from such equipment are desirable for landscaping, mulch and the like. Prior brush chippers capable of handling these larger size poles and limbs, however, have a tendency when chipping brush to pull long strips or twigs through without cutting them into uniformly sized chips. Such long pieces or twigs are not attractive, are not as useful and tend to be greatly troublesome when attempts are made to bag the chips. These twigs prevent proper filling of the bags.

In addition to these larger brush chippers for commercial use, there have also been very small chippers as for back yard use. These typically are comparable in size to lawn mowers and have an infeed hopper for the twigs and small branches to be fed down to the chipper at a drop angle of about 37 degrees. These small chippers also tend to pull long pieces of branch and twigs through rather than chipping them. Bagging is a problem. Efforts have been made to prevent these long strips or twigs from being pulled past the anvil by the knife in prior chippers by setting the anvil close to the knife, but then the brush has a tendency not to feed well. If the anvil is backed off from the knife for more effective feeding, then the twigs are pulled through. And they are totally incapable of chipping anything large. Hence, they have not been widely adopted.

As to bagging of chips, some lawn mower size chippers or shredders that bag the product have been proposed heretofore, but these small devices are not deemed practical except perhaps for occasional backyard usage as by a homeowner. There are also large machines capable of just bagging previously cut chips. Such commercial baggers of chips are expensive, and moreover do not create the chips, but just bag them. Such prior apparatus has not enabled effective creation and usage of wood chips by landowners, gardeners, landscapers, etc. of millions of tons of prunings and cleanup branches and brush occurring each year.

There has existed a need for equipment capable of chipping trimmings such as the annual prunings from fruit and nut trees, without pulling long twigs or strips through the chipper, but also capable of chipping larger pieces up to six or eight inches in diameter if necessary.

A chipper of smaller horsepower, e.g. about 25 h.p., and smaller size and lighter weight than that of the present commercial brush chippers, would be particularly advantageous, especially if it could also bag the chips, and if it dependably cut even twigs into small chips rather than passing long pieces. Such a chipper should also be capable of chipping limbs and poles up to several inches in diameter without jamming the chipper, since these are frequently encountered in cleanup operations. It should be capable of constant use on a commercial basis, yet easy to use as by rental agency customers.

SUMMARY OF THE INVENTION

An object of this invention is to provide a smaller horsepower, lower cost, commercial disc chipper than present commercial brush chippers, suitable for chipping the annual trimmings/prunings of fruit orchards and nut groves, and for landscaping and tree trimming businesses and the like in an economical manner, capable of effectively chipping twigs and small branches and brush into proper chip size, capable of chipping large diameter wood up to several inches in diameter, and also capable of optionally containerizing the chips. The novel machine is lightweight and can be readily moved as a unit on wheels to desired locations for use, and even moved during use. Its size allows it to pass through a grove or orchard without damage to the trees. It can move from tree to tree to tree to quickly chip the 50-75 pounds of branches at each tree. The prunings can be thrown directly into the chipper to avoid the usual costly cleanup on the ground. It can be in the form of a trailer unit as depicted herein, or self-propelled as disclosed in the parent application. It chips the prunings or the like and uses the momentum of the propelled chips to directly containerize the chips. The chips can moreover be directly discharged into a truck or on the ground, or alternately discharged into attached and supported containers such as bags after the chip momentum is arrested. Valuable chips in amounts of 100 or so 75 pound bags per hour are the result. Chips from the large volume of prunings, limbs, poles or brush assume only a fraction of the initial volume and are immediately useable and have definite value. These containers of chips are temporarily transportable on the novel apparatus for later transfer onto road vehicles if necessary, for use as mulch, fuel, ground cover, building top soil or the like, without a significant amount of added labor.

The chipper has a special feed roll and anvil cooperative relationship, the feed roll being immediately adjacent the disc and directly above the anvil, biased down toward the anvil to forcefully retain branches and twigs down on the anvil for cutting, largely preventing long twigs and strips from being pulled through the chipper disc. The feed roll is moreover capable of having additional biasing force applied manually by the operator in a desired amount, at will, and without danger, to selectively increase the infeed pressure on the brush or wood against the anvil as needed. There is no danger caused by this manual function because the operator's hands are totally outside the infeed space.

The chipper also has a knife to anvil relationship, an infeed spout arrangement and preferably a feed roller orientation, that causes maximum cutting torque to be applied to the wood, enabling chipping of poles and limbs several inches in diameter using a drive engine less than about one-third the horsepower of prior commercial brush chippers capable of accommodating this size wood.

The chipper can be regulated to produce chips over a large range from about one inch or so thick down to a fine mulch.

The chipper/bagger employs the velocity of the chips propelled from the fan blades on the chipping disc to propel them, preferably to a flow arrester in the form of a cyclone separator. The velocity of the chips and flowing air can be retarded by the flow arrester to cause the chips to drop into containers temporarily suspended adjacent the outlet for the chips. Successive containers are readily attachable to and detachable from chip outlet spouts to allow the machine operator to chip and bag containers of chips and temporarily retain and transport such to a common location. Alternatively the chips can be directed in bulk out of the apparatus into a vehicle such as a truck or trailer, or onto the ground.

These and other features, advantages and objects of the apparatus will become apparent upon studying the following specification in conjunction with the drawings.

DESCRIPTION OF THE PREFERRED EMBODIMENT

Figure 1:
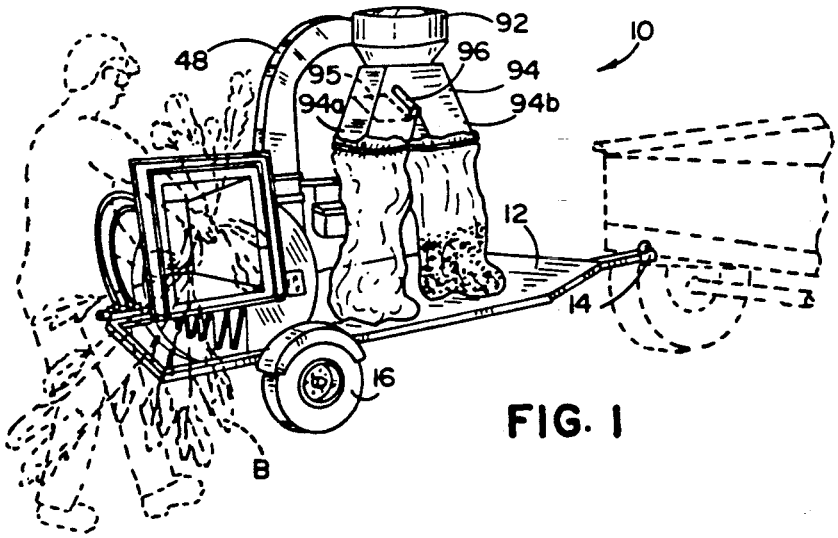
FIG. 1 is a perspective view of one embodiment of the novel apparatus, viewed toward the right rear of the machine, and showing brush being fed into the chipper infeed chute.
Figure 2:
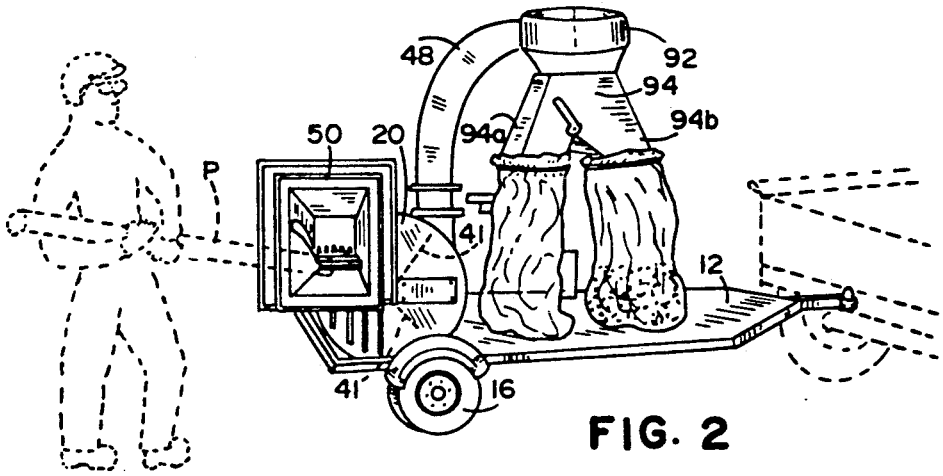
FIG. 2 is a perspective view of the apparatus in FIG. 1, showing a pole several inches in diameter being fed into the chipper infeed chute.

Referring now to FIG. 1, the complete assembly 10 there depicted is shown to include a wheeled platform 12 in the form of a trailer, including a pulling tongue and hitch 14 and wheels 16 on an axle. The unit may be readily pulled behind a truck, auto or tractor. Alternatively, it can be self-propelled as in the parent application.

In the following description, the use of the terms front, rear, side, etc. are relative to the orientation of the depicted embodiments, and not intended to be limiting in nature.

The remaining components of the chipper assembly, including the chipping disc, drive motor and chip handling components, are mounted on platform 12. The circular chipping disc 18 is within a surrounding generally cylindrical housing 20 and is mounted on a transverse central stub axle 22 which is secured to and projects from one face, the rear discharge face, of the disc. This axle extends through the adjacent wall of housing 20 and through a bearing 23 on main vertical support pillar 24, as well as through the pillar. Pillar 24 has its lower end mounted on beam 13 of platform 12 and extends upwardly to support other components. On the extended end of shaft 22 opposite the chipping disc is mounted a driven pulley 26.

Pulley 26, shaft 22 and chipping disc 18 are driven by a power source 28 such as a gasoline engine, through drive pulley 30 and endless drive means such as V-belt 32 extending around drive pulley 30 and driven pulley 26. Motor 28 has a base 28' mounted on platform 12 with threaded fasteners 36. The motor is adjustable relative to the disc. The adjustable arrangement includes a pair of elongated slots 12a in platform 12 through which bolt-type fasteners 36 extend to secure motor platform 28' to platform 12 in the desired position. This adjustment capability allows different size pulleys to be employed at 26 and 30 for setting the desired disc speed/power ratio.

Chipping disc 18 is preferably one to two inches thick, having knife means 40 on the front axial face thereof opposite to the rear face to which axle shaft 22 is secured. Radially extending knife means 40 (FIG. 6), preferably two in number and opposite each other, are mounted to the disc by fasteners 42. Each knife is mounted in a knife pocket 18' formed into disc 18 at an angle of about seven degrees to the disc face. Each pocket has a backup face 18'' for the knife. Adjacent each pocket is a slot 44 that extends through the disc from the front chipping face to the rear discharge face. Each knife projects axially out from the face of the disc a controlled distance at the small acute angle of about seven degrees. The inside face adjacent the cutting edge is at an angle of about 26 degrees or so to the outside face. Each knife is oriented radially on the disc and has its radially inner end approaching the center of the disc, spaced therefrom just slightly more than the radius of shaft 22. The cutting edge of each knife is a continuous linear edge lying substantially along the radius of the disc. Slots 44 adjacent the leading sharp edge of the respective knives each form a passageway to cause the chips cut by the knife to pass through the disc to the rear discharge face. On this discharge face are mounted a plurality of conventional radially extending fan blades 41 which propel the cut chips through the tangentially oriented discharge chute 48 on housing 20. An opening on the front side of the housing 20, under removable plate 20'', allows access to the knives for adjustment or removal and replacement. A perforated plate 21 covering an opening on the rear side of the housing allows air entry for travel with the discharged chips.

The infeed chute 50 through which material is fed to the chipping disc is oriented generally laterally, having an open outer end and an inner throat where it is joined to housing 20. It is somewhat convergent toward the throat. One side wall of the chute is positioned close to the center of the disc, such that the horizontal anvil 54 at the chute throat has its radially inner end close to the vertical plane that passes through the disc center, as will be expiained more fully hereinafter. The cooperative knives also have their inner ends close to the disc center, so that the radially inner end of the knife is adjacent said chute side wall. Housing 20 has an opening on one side, contiguous with the throat of the infeed chute, allowing access of wood to the chipping disc. Thus, secured to and extending from the housing around this opening is infeed chute 50 shown to have a top, two sides and a bottom. This bottom 50' also serves as a support for brush B (FIG. 1), poles P or limbs fed to the chipping disc. Bottom 50' is almost horizontal, i.e. almost perpendicular to the disc. It preferably is at a small acute downwardly sloping angle of about 10–12 degrees. This is in sharp contrast to the angle of about 37 degrees for conventional small brush chippers. Anvil 54 is basically normal to the disc.

Figure 4:
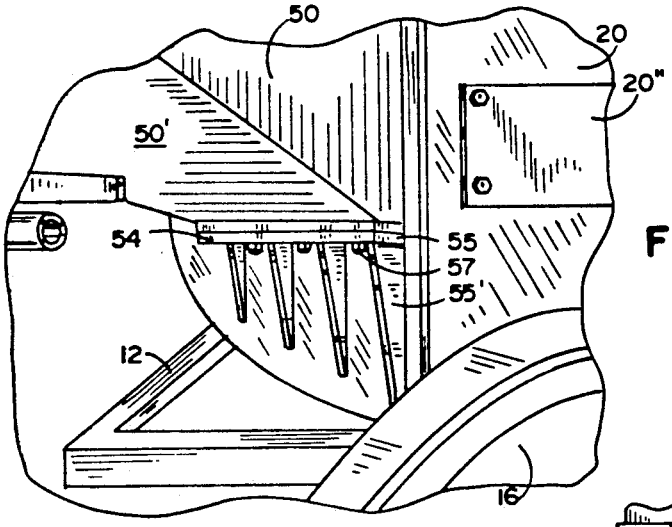
FIG. 4 is a fragmentary perspective view showing the underside of the infeed chute and the mounted anvil.
Figure 5:
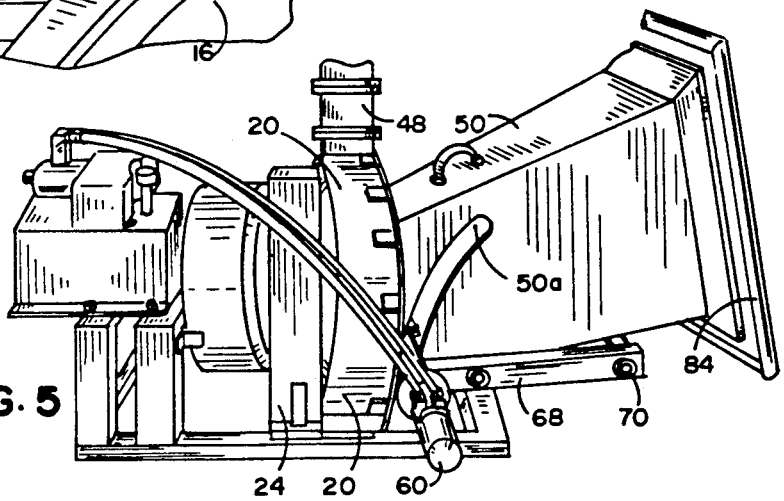
FIG. 5 is a view toward the rear of the apparatus.

At the inner throat of support 50', immediately adjacent disc 18 so as to be spaced only thousandths of an inch from revolving knives 40, is the anvil 54. The anvil inner edge is spaced about 20 thousandths to about 150 thousandths of an inch from the protruding cutting edge of the passing knives, with 75 thousandths to 100 thousandths being preferred. Anvil 54 is securely mounted atop a platform 55 (FIG. 4) by removable fasteners 57. The fasteners extend through slots to allow anvil adjustment relative to the disc. The fasteners also enable anvil reversal after wear of one edge thereof, and anvil replacement as necessary. Platform 55 is braced by a series of vertical diagonal supports 55' (FIG. 5) because of the stress repeatedly applied to the anvil. This anvil is cooperative with the passing knives to chip the wood. Both the chipping knives and the anvil are formed of hardened materials, usually steel.

Figure 3:
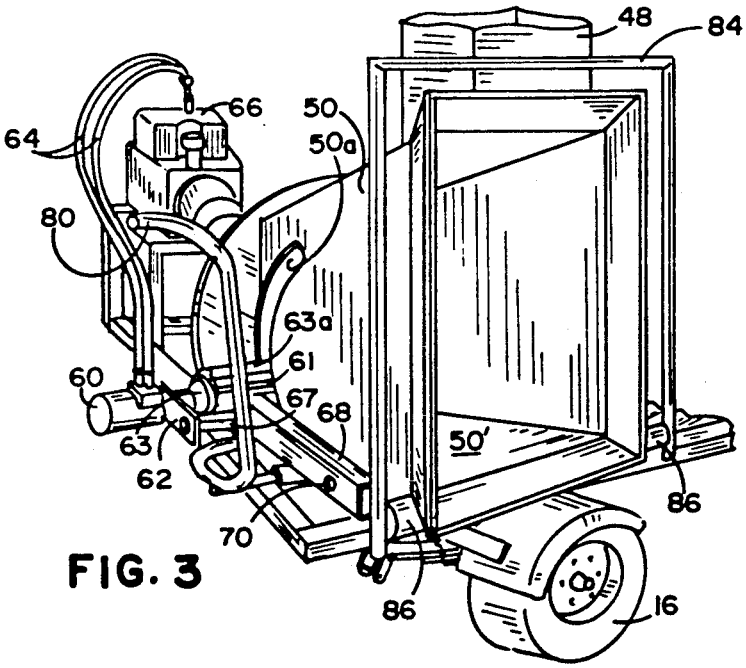
FIG. 3 is a perspective view toward the right rear of the machine in FIGS. 1 and 2, showing the drive motor for the feed cylinder. and the manual lift and pressure control for the pressing feed cylinder.
Figure 6:
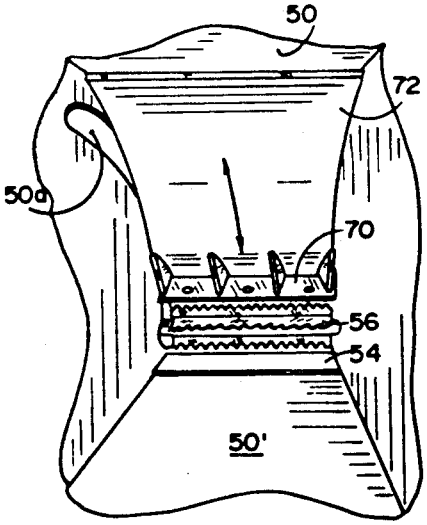
FIG. 6 is a fragmentary view into the infeed chute of the apparatus showing the pressing feed cylinder adjacent and above the anvil.
Figure 7:
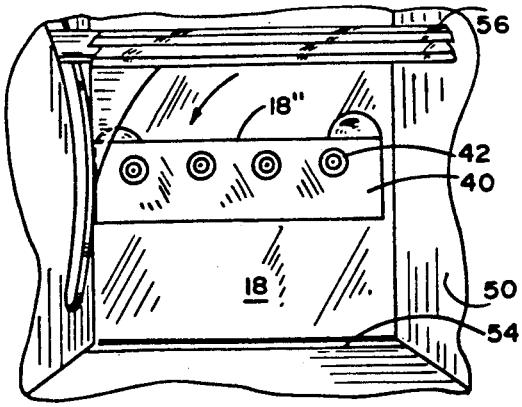
FIG. 7 is an enlarged fragmentary view of the throat of the infeed chute in FIG. 5, with the pressing infeed roll and the deflector thereabove purposely manually elevated for viewing of a chipping knife on the disc beginning to approach the anvil.
Figure 8:
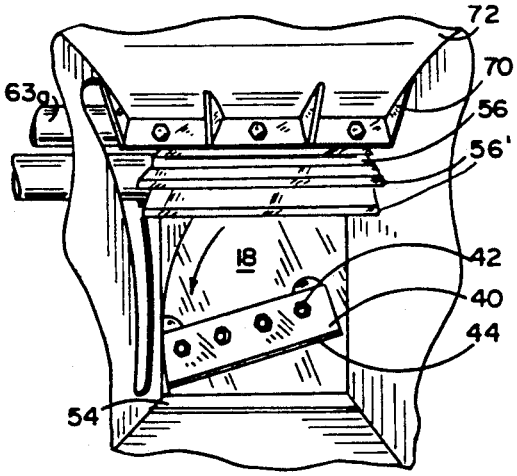
FIG. 8 is a fragmentary perspective view into the infeed chute, showing the chipping knife further approaching the anvil, and showing the anvil itself, and also the pressing feed cylinder and deflector still in the purposely elevated condition.
Figure 10:
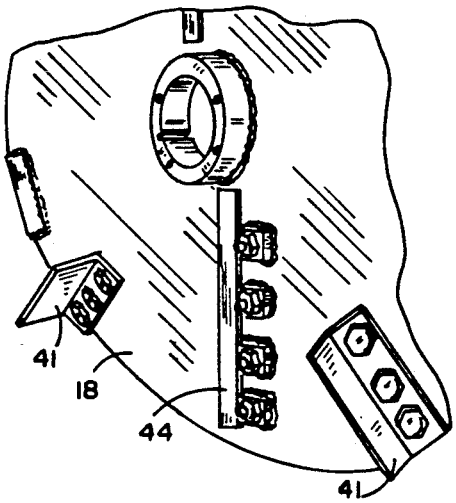
FIG. 10 is a fragmentary perspective view of the rear, i.e. discharge, face of the disc.

Above anvil 54, immediately adjacent disc 18 and generally parallel to the anvil, is a special small diameter wood pressing and feed roll 56 a few inches in diameter. This cylinder is purposely mounted only a fraction of an inch from the disc, usually about one-half inch, so as to just be cleared by the passing knives. It is small in diameter compared to the chute height and to the disc, to be directly above the anvil, and to be vertically movable in the chute. This special cylinder is shown to have a plurality of radially projecting, axially extending wood engaging teeth portions. Each of these portions can optionally have serrated outer edges as depicted in FIG. 6, or preferably linear sharp outer edges as depicted in FIGS. 7 and 8. In either type, the outer edges are capable of penetrating and therefore forming a biting action on wood fed into the infeed chute. For a disc about 28 inches in diameter, and an infeed chute about 20 inches high, this pressing feed cylinder is preferably about three inches in diameter and the teeth or blades project about three-quarter inch more, so that the total diameter is about four and one-half inches. The cylinder extends basically the full width of the infeed chute. Importantly, the roll presses and holds the wood down horizontally on the anvil as it feeds the wood to a point where the chipping knives can engage the wood and chip it. During chipping, the knife pulls the wood to feed it. This cylinder is rotationally powered, preferably by a rotary hydraulic motor 60 (FIG. 3) affixed directly to the end of the cylinder. Motor 60 is powered with hydraulic fluid through fluid pressure lines 64 from a pump and pumping reservoir 66 of conventional type. Motor 60 and cylinder 56 are secured to an elongated pivot arm 68. Motor 60 has its drive shaft extending through cylindrical housing 63 which is secured to pivot arm 68. Also, motor 60 is attached to plate 62 which is attached by a pin 67 to pivot arm 68. Pivot arm 68 has a fixed pivot axle 70 at its outer end opposite the end to which housing 63 and motor 60 are secured.

Motor 60 drives its rotary shaft 61 which extends through housing 63 and through an arcuate slot-type opening 50a in the adjacent sidewall of infeed chute 50. Cylinder 56 is on shaft 61. Also extending through slot 50a is a support pin 63a from housing 63. Secured to this pin 63a inside the chute is a deflector 72 described hereinafter. Pivot arm 60a enables motor 60, shaft 61 and cylinder 56 to move vertically as a unit in an arcuate path depicted by slot 50a, from a lower position immediately adjacent and above anvil 54 to an elevated position several inches higher. Cylinder 56 is biased down toward anvil 54 by its own weight and the weight of the other components attached thereto. Additional mechanical biasing means as by springs could be applied if desired. This bias toward anvil 54 tends to forcefully push and hold wood tightly against the anvil during the cutting action. If the wood such as branches and twigs is held securely against the horizontal anvil a fraction of an inch from the knife as the knife passes vertically, neat chips are formed. If the brush is not so held, as in the prior art, it tends to be tipped up and dragged past the anvil by the passing knife, resulting in long, undesirable pieces several inches in length.

The novel apparatus also enables additional pressure of desired amount to be readily manually applied by force on the handle 80 (FIG. 3) secured to pivot arm 68. The lower inner end of handle 80 is secured to pivot arm 68 at two places, one of which is near pivot axle 70 (FIG. 3), to form a leverage effect, allowing arm 68 to be pivoted by pulling or pushing on the handle The upper outer end extends away from the housing for grasping by a person's hand. Thus, by pulling on the upper outer end, pivot arm 68 will be raised to manually pivot about its axis 70, elevating motor 62, housing 63, shaft 61, the rotating cylinder 56 and the deflector 72 to raise the members for reasons noted below. The operator can also push a desired amount and for a desired time period on this handle to force rotating roller 56 against the wood down onto the anvil. This aids the cylinder feeding action. This action is done without the operator's hands being put inside the chute or in danger. This feature provides a significant advantage and safety feature since it not only aids infeed of plugging material or large material, but also removes the temptation of the operator to reach into the infeed chute and push the material toward the knives. There is an advantage to this infeed roll arrangement when introducing a large diameter piece of wood or clump of branches to the disc. Normally, the rotating feed cylinder will climb up over the infeed material, gripping it and pushing it toward the disc. If it does not climb over it, however, the rotating feed cylinder is simply elevated by pulling handle 80 sufficiently to allow the material to begin passing beneath it and then lowered again onto the material to feed it.

Secured to the inner end of mount 63*a* is a bracket 70 which supports the upstanding diagonal deflector 72. Deflector 72 protrudes upwardly and outwardly toward the input outer opening of chute 50. This deflector causes the inner ends of branches, brush, twigs or poles being inserted into the infeed chute to be deflected downwardly to the rotating presser cylinder 56 which forces the wood beneath it and down onto the anvil into the chipping disc. Deflector 72 moves vertically with the cylinder. (Compare FIGS. 6 and 8.) The deflector also prevents pieces of wood from being thrown back by the knives over cylinder 56 toward the infeed opening.

Knife 40 has a special arrangement relative to anvil 54. The anvil is in chordal arrangement to the disc, offset below the rotational axis of the disc several inches, preferably about six to eight inches. Knife 40 is oriented to have its cutting edge about on the disc radius. Therefore, when the rotating knife is horizontal to be parallel to the anvil (FIG. 7), i.e. horizontal in the form depicted, it is spaced six to eight inches from the anvil to accept a piece of wood or clump of brush that large in diameter and still be able to advance such toward the center of the disc as explained further herein. As the knife advances further (FIG. 8), the arrangement will cause the outer end portion of the knife to pass the outer end portion of anvil 54 prior to the remaining inner portions of the knife passing inner portions of anvil 54. The knife portions progressively pass the anvil portions from outer end to inner end. The continuous linear knife edge thus has a force vector toward the center of the disc applied to the wood, as well as a force vector toward the anvil, thereby pushing the wood toward the inner end of the knife and anvil near the center of the disc where the cutting force leverage is greatest. Also, to assist in this action cylinder 56 is preferably canted at a small acute angle relative to the anvil, up to about 15 degrees, the outer end of the cylinder being closer to the anvil than the inner end of the cylinder. This also tends to push the wood toward the center of the disc. As a result of this pressing and feeding action by the cylinder against the anvil and coaction between the knife and anvil with rotation of the chipping disc, the wood forced to a position near the rotational axis of the disc has the greatest cutting leverage applied to it. This is in contrast to accepted practice of having the chipping performed on the outer end portion of the knife some 2–3 inches from the rim. This present combination enables a far smaller horse power drive unit of about 25 h.p. to chip large diameter pieces formerly requiring 75 h.p. or more. Experimental operation with a 25 h.p. unit has shown that poles six to eight inches in diameter can be dependably chipped without stalling the engine or excess slippage of drive belts as previously experienced. Yet the unit with this arrangement is capable of also neatly and reliably chipping small brush, twigs and trimmings effectively.

For additional control, hydraulic motor 60 is stoppable and reversible to drive cylinder 56 in reverse or forward directions or to stop its rotation as in U.S. Pat. No. 3,861,602. This is controlled by a manual lever 84 of conventional type having a generally inverted U-shaped configuration. It is mounted adjacent the inlet opening of chute 50 on pivot pins 86 at the lower ends of its opposite legs. Pushing and pulling of lever 84 operates a control valve (not shown) for stopping or reversing the direction of hydraulic fluid through lines 64 to motor 60. This enables infeeding wood to be stopped or backed out as desired, and serves a safety function.

Figure 12:
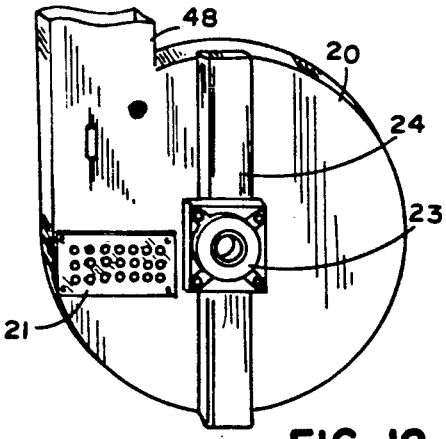
FIG. 12 is a rear elevational view, slightly in perspective, of the disc housing and support pillar in FIG. 11.
Figure 13:
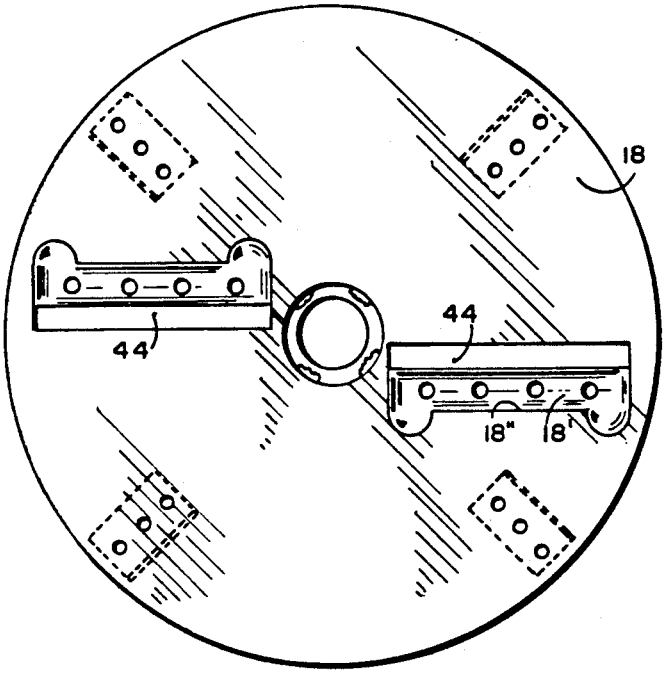
FIG. 13 is an elevational view of the front, i.e. chipping face of the disc, but without the knives being mounted thereon.

Extending tangentially from housing 20 is the discharge chute 48 depicted as extending curvilinearly upwardly outwardly to a cyclone separator 92 serving as a flow arrester for chips and air discharged from the chipper disc. The top of separator 92 has a conventional top opening 92' for discharge of excess air pulled into housing 20 through an inlet plate 21 in the housing wall (FIG. 12) and traveling with the chips. Depending from separator 92 is a bifurcated drop chute means 94 shown to include two alternate chutes 94*a* and 94*b*. These each have an open lower end. Around each of these lower ends is a flange member over which the upper open end of a chip receiving bag or equivalent container resting on platform 12 can be placed. The bags are preferably retained on these flanges by respective circumferential tension coil springs or the equivalent. Each spring extends around the chute for squeezing and holding a bag on the chute above the flange. A bag upper end is pulled up over the flange and the coil garter spring or rubber equivalent pulled down over it to retain it in place. Bags can be alternately filled with chips dropping from the flow arrester through these spouts by shifting a pivotal butterfly valve 95 between the spouts within housing 94, using external pivot handle 96.

Figure 17:
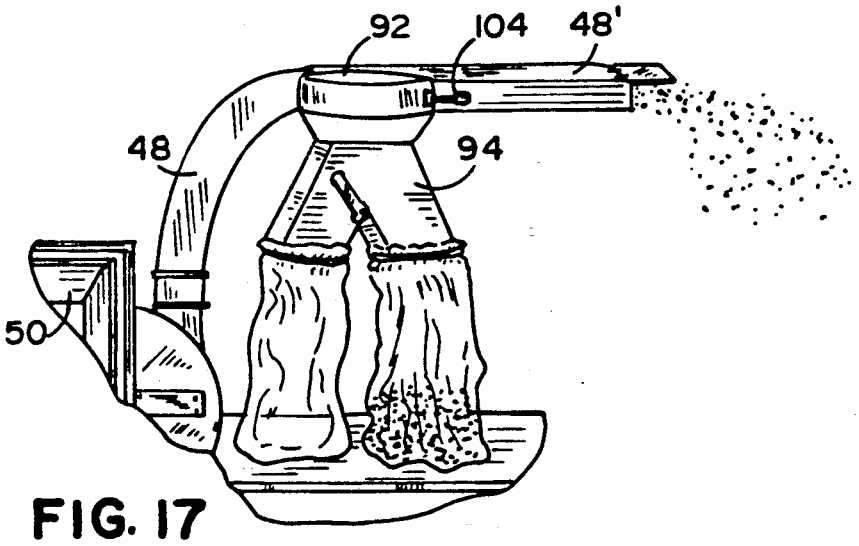
FIG. 17 is a fragmentary perspective view of another embodiment of the apparatus with a discharge spout extension.
Figure 18:
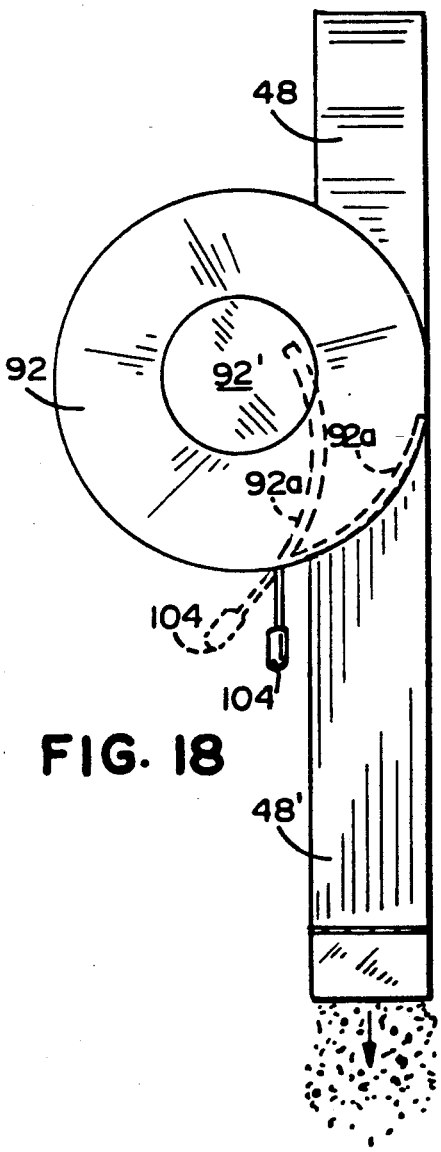
FIG. 18 is a top plan view of the discharge apparatus in FIG. 13.

In the embodiment depicted in FIGS. 17 and 18, the chips can, instead of being bagged, be optionally propelled through a chute extension 48' downstream of the cyclone unit so as to bypass the cyclone unit. This is accomplished by providing chute extension 48' and an arcuate valve segment 92*a* of the cyclone wall (FIG. 18) pivotally shiftable on pin 102 between a first position (phantom lines) blocking flow to the chute extension and forming part of the separator wall so that they enter the cyclone separator, and a second position allowing the chips to bypass the separator directly to extension 48'. This valve is shifted with an exterior pivot handle 104.

Figure 9:
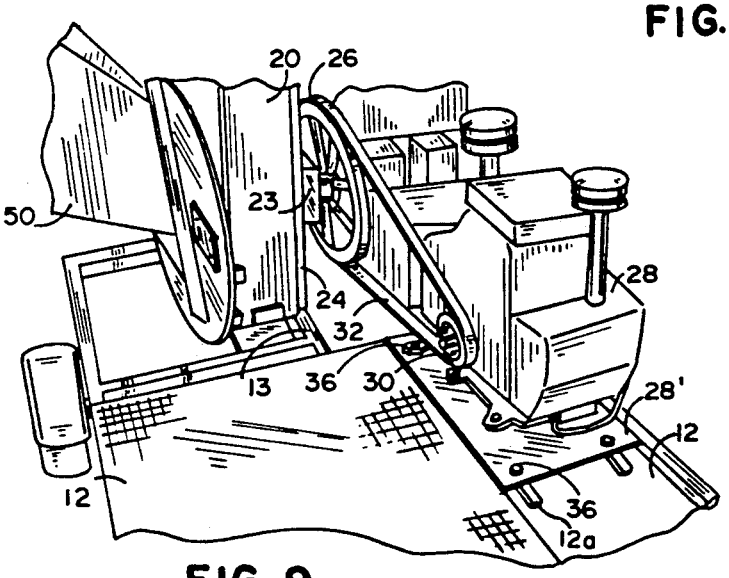
FIG. 9 is a fragmentary perspective view of the drive motor and pulley assembly for the chipper disc.
Figure 11:
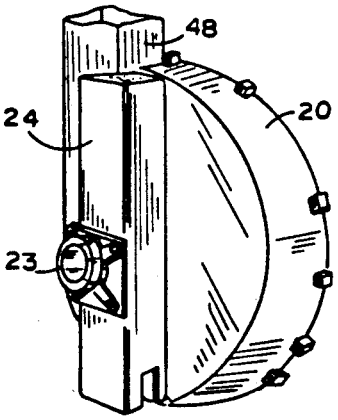
FIG. 11 is a rear perspective view of the housing for the disc and the main support pillar for the machine.
Figure 15:
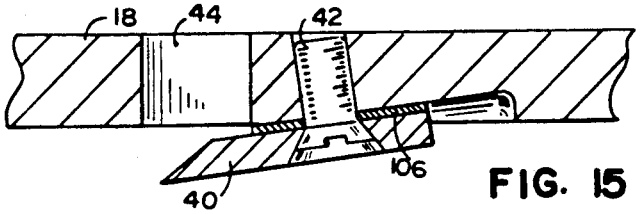
FIG. 15 is a fragmentary enlarged sectional view of a portion of the disc with a knife and an optional shim mounted in place.
Figure 14:
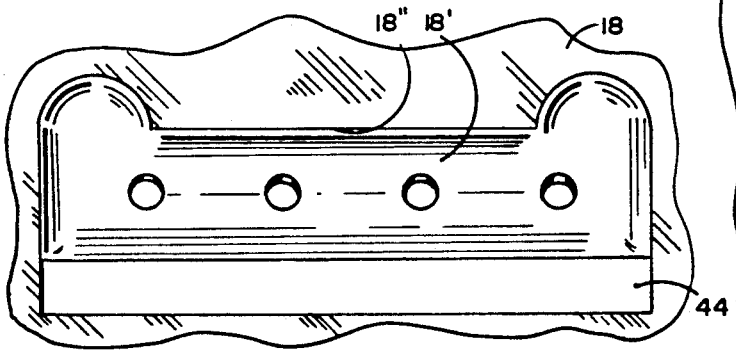
FIG. 14 is an enlarged view of one knife pocket and adjacent slot through the disc.
Figure 16:
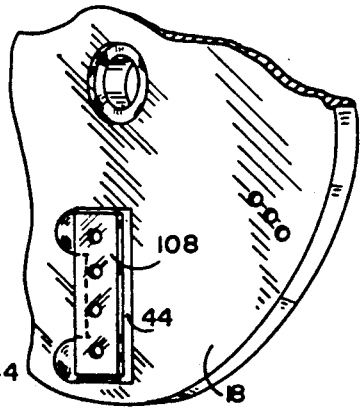
FIG. 16 is a fragmentary perspective view of the disc with a blank mounted in one knife pocket and the other pocket still empty.

The chipping apparatus can produce a variety of chip sizes, from about one inch thickness to a small mulch. This is achieved with a selected combination of drive and driven sheave or pulley ratios and thus disc speed, knife width, knife spacing from the disc, and number of knives. Specifically as to the sheaves, selected diameter sheaves 26 and 30 can be mounted on their respective shafts and the belt tightened by adjusting engine platform 28' on platform 12 (FIG. 9). This controls the disc speed. As to the knife width, the cutting edge location of the edge of each knife 40 can differ if a narrower knife (e.g. one that has been repeatedly sharpened) is mounted rather than a wider knife. Knife spacing from the disc also depends upon whether one or more shim spacers 106 (FIG. 15) of desired thickness is placed between the knife and disc. The number of blades can be varied as by bolting a blank 108 (FIG. 16) in one knife pocket, leaving only one knife in a two pocket disc. The blank is flush with the disc face and is retained by threaded fasteners through the disc at the knife pocket. To the extended ends of the fasteners can be attached suitable counterweights on the discharge face of the disc. If very large chips are desired, the disc is rotated more slowly, a wider knife is used, a greater spacing of the knife from the disc is provided by one or more shim spacers, and a blank is mounted in one pocket. If very small chips are desired, the disc is rotated more rapidly, narrower knives are used, no spacers are employed, and all pockets are filled with knives.

In operation of the apparatus, it is moved on its wheels to the desired location, as in an orchard, a nut grove, along a curbside or elsewhere to trim small branches, larger poles and branches up to about eight inches or so in diameter, using an engine of only about 25 h.p. The engine 28 drives the disc via the V-belt to rotate disc 18 and knives 40 past anvil 54. It also drives the hydraulic pump to operate motor 60 for rotating infeed pressing cylinder 56 down toward anvil 54 and the disc 18. One end of the wood is manually inserted into chute 50, where cylinder 56 engages it, presses it down onto anvil 54 and advances it to the rotating knives. If the wood is too large for cylinder 56 to climb onto it, the operator pulls on handle 80 temporarily to elevate cylinder 56 sufficiently for the wood to pass beneath it. As cylinder 56 presses the wood on the anvil and feeds it to the knives, the knives slice into it and pull it while cutting, and the chips pass through the slots in the disc to the fan blades on the rear. If the wood or brush tends to jam at the disc, the operator can manually push down on handle 80 to momentarily apply selected amounts of greater force by cylinder 56 against the wood, for better feeding action to the disc. If it still does not fully feed in, the operator can reverse cylinder 56 to back the wood out.

The wood fed in, particularly larger diameter wood, is caused by the knife-to-anvil and cylinder-to-anvil relationship to move to the inner ends of the knife and anvil for maximum cutting leverage. A pole several inches in diameter will thus tend to be at an angle to the passing knife, usually a compound angle, the inner end of the pole being at the one side wall of the chute near the disc center and the outer end tending to move to the opposite side wall of the chute, and the pole also following the downward tilt of the chute bottom.

The chips thrown through discharge chute 48 are directed to flow arrester 92 for the chips to drop through one or the other chutes 94*a* and 94*b* into bags retained thereon, or propelled out the laterally oriented discharge opening of the chute extension 48' into a truck, trailer, container or onto the ground.

Hence, worthless and troublesome brush, branches and the like can be quickly converted to valuable, useable chips of high quality, in containers. Testing shows the apparatus can fill one hundred 70 pound bags per hour, using only a 25 h.p. engine.

Additional advantages and obvious variations to the depicted and described preferred versions of the invention may well occur to those in the art. The invention is intended to be limited only by the appended claims and the equivalents thereto.

The embodiments of the invention in which an exclusive property or privilege is claimed are defined as follows:

1. A wood chipper comprising:

a rotational chipping disc having radial knife means on an axial cutting face thereof for chipping brush and other elongated pieces of wood, said knife means projecting from said axial cutting face at an acute angle;

said knife means having a continuous linear cutting edge with a radially outer end and a radially inner end, said radially inner end being close to the center of said disc;

a housing around said disc;

an infeed chute to said disc, having a wall close to the center of said disc, having an open outer end to receive wood to be chipped and having an inner end;

said knife means radially inner end being adjacent said infeed chute wall;

an anvil fixed at said infeed chute inner end and closely adjacent said disc face but spaced therefrom, said anvil having an elongated dimension oriented chordally of said disc such that said knife means passes closely adjacent said anvil to cut wood therebetween;

said knife means being canted relative to said anvil, with said radially outer end of said cutting edge advanced in position relative to the direction of rotation of said disc to pass said anvil first before the remaining portions of said knife means pass said anvil and cause successive adjacent radially inner portions of said knife means to progressively advance to and past said anvil in a manner to force wood being cut to be shifted radially inwardly to said disc along said linear cutting edge to said radially inner end of said cutting edge and said infeed chute wall;

a powered feed cylinder in said infeed chute, adjacent said anvil, and closely adjacent said disc cutting face;

said feed cylinder being movable to relative to said anvil and being biased toward said anvil and cooperative therewith to squeeze wood and brush thereagainst as the wood is engaged by said knife means; and operator controlled handle means outside said infeed chute and operably associated with said powered feed cylinder for enabling said feed cylinder to be momentarily moved away from said anvil for entry of larger diameter wood between said feed cylinder and said anvil and enabling extra bias to be manually applied by said feed cylinder against wood on said anvil.

2. The wood chipper in claim 1 including a pivotal support mounting said feed cylinder, and said handle means being connected to said pivotal support.

3. The wood chipper in claim 1 wherein said feed cylinder is canted at a small acute angle relative to said anvil, the outer end of said cylinder being closer to said anvil than the inner end of said cylinder so that the cooperative action of said knife means, cylinder and anvil tned to shift wood being cut radially inwardly of said disc.

4. A wood chipper comprising:

a rotational chipping disc having radial knife means on an axial cutting face thereof for chipping brush and other elongated pieces of wood, said knife means projecting from said axial cutting face at an acute angle;

said knife means having a continuous linear cutting edge with a radially outer end and a radially inner end, said radially inner end being close to the center of said disc;

a housing around said disc;

an infeed chute to said disc, having a wall close to the center of said disc, having an open outer end to receive wood to be chipped and having an inner end;

said knife means radially inner end being adjacent said infeed chute wall;

an anvil fixed at said infeed chute inner end and closely adjacent said disc face but spaced therefrom, said anvil having an elongated dimension oriented chordally of said disc such that said knife means passes closely adjacent said anvil to cut wood therebetween;

said knife means being canted relative to said anvil, with said radially outer end of said cutting edge advanced in position relative to the direction of rotation of said disc to pass said anvil first before the remaining portions of said knife means pass said anvil and cause successive adjacent radially inner portions of said knife means to progressively advance to and past said anvil in a manner to force wood being cut to be shifted radially inwardly to said disc along said linear cutting edge to said radially inner end of said cutting edge and said infeed chute wall;

a pressing feed cylinder in said infeed chute and closely adjacent said disc, in cooperative relation with and generally parallel to said anvil, and biased toward said anvil; and power motor means for said feed cylinder to rotate said feed cylinder toward said anvil and said disc for forcefully holding infed poles, limbs and branches down against said anvil while feeding such to said cutting face for cutting into chips the poles, limbs and branches between said knife means and said anvil.

5. The wood chipper in claim 4 wherein said feed cylinder is movable vertically varying distances from said anvil against said bias to accommodate varying diameter pieces of wood and brush while pressing the wood and brush against the anvil and feeding it toward said disc.

6. The wood chipper in claim 5 wherein said motor means is attached to and movable vertically with said feed cylinder; and handle means outside of said chute and connected to said motor means and cylinder for manually shifting said cylinder momentarily away from said anvil and for allowing manual force to be applied by said cylinder against wood on said anvil.

7. The wood chipper in claim 5 including a deflector in said infeed chute above said feed cylinder to deflect wood down between said feed cylinder and said anvil.

8. The wood chipper in claim 7 wherein said deflector is attached to and movable vertically with said feed cylinder.

9. A wood chipper comprising:

a rotational chipping disc having radial knife means on an axial chipping face thereof for chipping brush and other elongated pieces of wood, said knife means projecting from said axial face at an acute angle;

an anvil fixed closely adjacent said face, said anvil having an elongated dimension oriented generally chordally of said disc such that said knife means passes closely adjacent said anvil to cut wood therebetween;

a wood pressing feed cylinder also closely adjacent said disc and generally parallel to said anvil and in cooperative relationship with said anvil;

said feed cylinder being movable away from and toward said anvil to accommodate varying diameter pieces of wood, and being biased toward said anvil to press the wood thereagainst;

power motor means for rotationally driving said feed cylinder in a direction to rotate said feed cylinder toward said anvil and said disc while forcefully holding wood and branches against said anvil as such are cut by said knife means.

10. The wood chipper in claim 9 wherein said feed cylinder is canted at a small acute angle relative to said anvil, with the outer end of said cylinder being closer to said anvil than the inner end of said cylinder.

11. The wood chipper in claim 10 wherein said motor means is movable vertically with said feed roll.

12. The wood chipper in claim 10 including a deflector above said feed cylinder to deflect wood down between said feed cylinder and said anvil.

13. The wood chipper in claim 12 wherein said deflector is movable vertically with said feed cylinder.

14. The wood chipper in claim 9 including a wood support platform extending to said anvil.

15. The wood chipper in claim 14 wherein said platform is at a small acute angle from a plane perpendicular to said disc face in a direction away from the advancing knife means.

16. A wood chipper comprising:

a rotational chipping disc having radial knife means on an axial face thereof for chipping brush and other elongated pieces of wood, said knife means projecting from said axial face at an acute angle;

an anvil fixed closely adjacent said face, said anvil having an elongated dimension oriented generally chordally of said disc such that said knife means passes closely adjacent to said anvil to cut wood therebetween;

said anvil being substantially normal to said disc chipping face;

an infeed chute to said disc, the bottom of which is a support for wood being fed to said chipper;

said anvil being at the inner end of said support; and a powered infeed pressure cylinder generally parallel to said anvil, closely adjacent said disc and biased toward said anvil, to press infed wood against said anvil and hold it while feeding it to said disc for cutting by said knife means.

17. A wood chipper comprising:

a rotational chipping disc having radial knife means for chipping brush and other elongated pieces of wood;

a housing around said disc;

an infeed chute to said disc having an open outer end to receive wood to be chipped and having an inner end;

an anvil fixed at said infeed chute inner end;

a powered feed cylinder in said infeed chute, adjacent said anvil and said disc cutting face;

said feed cylinder being movable relative to said anvil and cooperative therewith to squeeze wood and brush thereagainst as the wood is fed to and engaged by said knife means; and operator controlled handle means outside said infeed chute and operably associated with said powered feed cylinder for enabling said feed cylinder to be momentarily moved away from said anvil for entry of larger diameter wood between said feed cylinder and said anvil and enabling selected amounts of force to be manually applied by said feed cylinder against wood on said anvil.

18. The wood chipper in claim 17 wherein said powered feed cylinder is mounted on a pivotal support, and said handle means is attached to said pivotal support.

19. A wood chipper comprising:

a rotational chipping disc having radial blade means for chipping brush and other elongated pieces of wood;

an anvil fixed closely adjacent said face, said anvil having an elongated dimension oriented generally chordally of said disc such that said blade means passes closely adjacent said anvil to cut wood therebetween;

said blade means being canted relative to said anvil, with the radially outer end thereof being advanced in position relative to the direction of rotation of said disc to pass said anvil first before the remaining portions of said blade means pass said anvil and cause successive adjacent radially inner portions of said blade means to progressively advance to and past said anvil in a manner to force wood being cut to be shifted radially inwardly of said disc; and a powered feed cylinder adjacent and generally parallel to said anvil and adjacent said disc for pressing wood against said anvil as the wood is fed to and chipped by said knife means.

* * * * *